United States Patent [19]

Seipel

[11] 4,007,841

[45] Feb. 15, 1977

[54] ARTICLE DISPLAY RACK

[75] Inventor: Thomas E. Seipel, Sun Prairie, Wis.

[73] Assignee: Oscar Mayer & Co. Inc., Madison, Wis.

[22] Filed: Feb. 12, 1973

[21] Appl. No.: 332,024

[52] U.S. Cl. ..... 211/59.1; 248/214; 248/225.3

[51] Int. Cl.[2] ..... A47F 5/00

[58] Field of Search ..... 211/54, 57, 59, 68, 211/184; 248/121, 214, 215, 223, 226 R

[56] References Cited

UNITED STATES PATENTS

| | | | |
|---|---|---|---|
| 1,313,307 | 8/1919 | Locraft | 211/86 X |
| 2,280,371 | 4/1942 | Bishop | 211/184 |
| 2,572,090 | 10/1951 | Allen | 211/184 X |
| 2,936,902 | 5/1960 | Sinclair | 211/86 |
| 3,174,627 | 3/1965 | Marschak | 211/57 |
| 3,221,893 | 12/1965 | Glaberson et al. | 211/59 |
| 3,435,957 | 4/1969 | Lloyd | 211/86 |
| 3,481,487 | 12/1969 | Paruolo | 211/86 X |
| 3,486,632 | 12/1969 | Balch | 211/57 |
| 3,567,036 | 3/1971 | Tonjum et al. | 211/57 |

FOREIGN PATENTS OR APPLICATIONS

| | | | |
|---|---|---|---|
| 837,829 | 3/1952 | Germany | 211/86 |
| 172,480 | 12/1921 | United Kingdom | 211/86 |

*Primary Examiner*—Roy D. Frazier
*Assistant Examiner*—Thomas J. Holko
*Attorney, Agent, or Firm*—Lockwood, Dewey, Zickert & Alex

[57] ABSTRACT

A package display and support rack for mounting on shelves formed of wire rods found in refrigerators with glass doors such as used in convenience food stores. The display racks are inexpensively assembled from readily available or easily manufactured components and include forwardly projecting support feet attached at their heels or rear ends to the bottom ends of upright side members of the rack. The support feet have clamps on their distal ends for clamping attachment to at least one wire rod of a shelf.

1 Claim, 5 Drawing Figures

ARTICLE DISPLAY RACK

This invention relates generally to display racks of the general type having forwardly projecting article supporting rods and relates particularly to such racks which are adapted to be mounted on grill-like shelves formed of wire rods such as are commonly used in glass door refrigerator cases used in convenience food stores and the like.

Display racks of the type having forwardly projecting article supporting rods are known which are adapted to be mounted on a verticle wall or support plate for use in open top refrigerator display cases as used in supermarkets and the like. For example, display racks of this type are disclosed in U.S. Pat. No. 3,486,632 dated Dec. 30, 1969. However, such prior display racks are not suited for use in refrigerator display cases such as used rather extensively in smaller supermarkets or convenience food stores which have swinging or sliding glass doors at the front and which have no back wall but open directly into a refrigerated cold storage room for loading. Such refrigerator display cases with glass doors at the front do not have vertical walls or plate members by which the prior display racks have been mounted.

Accordingly, the object of the present invention, generally stated, is the provision of novel article display racks of the type described having a plurality of forwardly projecting article support rods and which are particularly adapted to be mounted on horizontal shelves found in refrigerator display cases having glassed-doors at the front and which are frequently used in convenience food stores and the like.

An important object of the invention is the provision of such novel article display racks having forwardly projecting foot members with clamping means on their distal ends by which they may be readily clamped to a wire shelf.

Certain other objects of the invention will be obvious from the detailed description of a presently preferred embodiment thereof.

For a more complete understanding of the nature and scope of the invention reference may now be had to the following description of a presently preferred embodiment taken in connection with the accompanying drawing, wherein.

Figure 2:
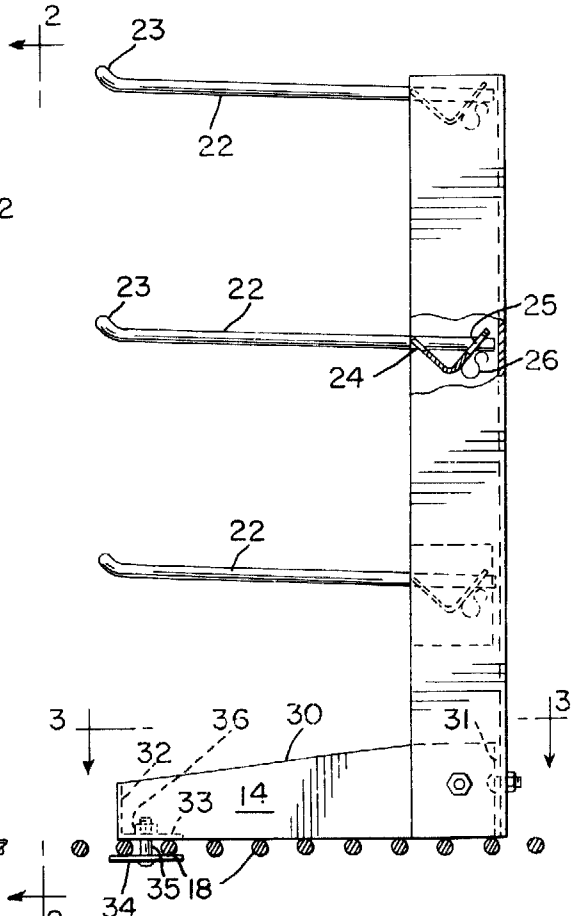
FIG. 2 is an elevational view taken on line 2—2 of FIG. 1 and partly broken away.

Referring to the drawings a display rack is indicated generally at 10 having two uprights 11 and 12 at opposite sides each of which has a support foot 13 and 14, respectively, attached to the lower end thereof and projecting forwardly therefrom. Two permanent horizontal support bars 15 and 16 extend between the uprights 11, 12 and a removable horizontal support bar 17 may be utilized, if desired. The support feet 13 and 14 rest on a shelf formed of parallel wire rod 18—18 to a pair of which the distal ends of the feet are clamped.

Figure 1:
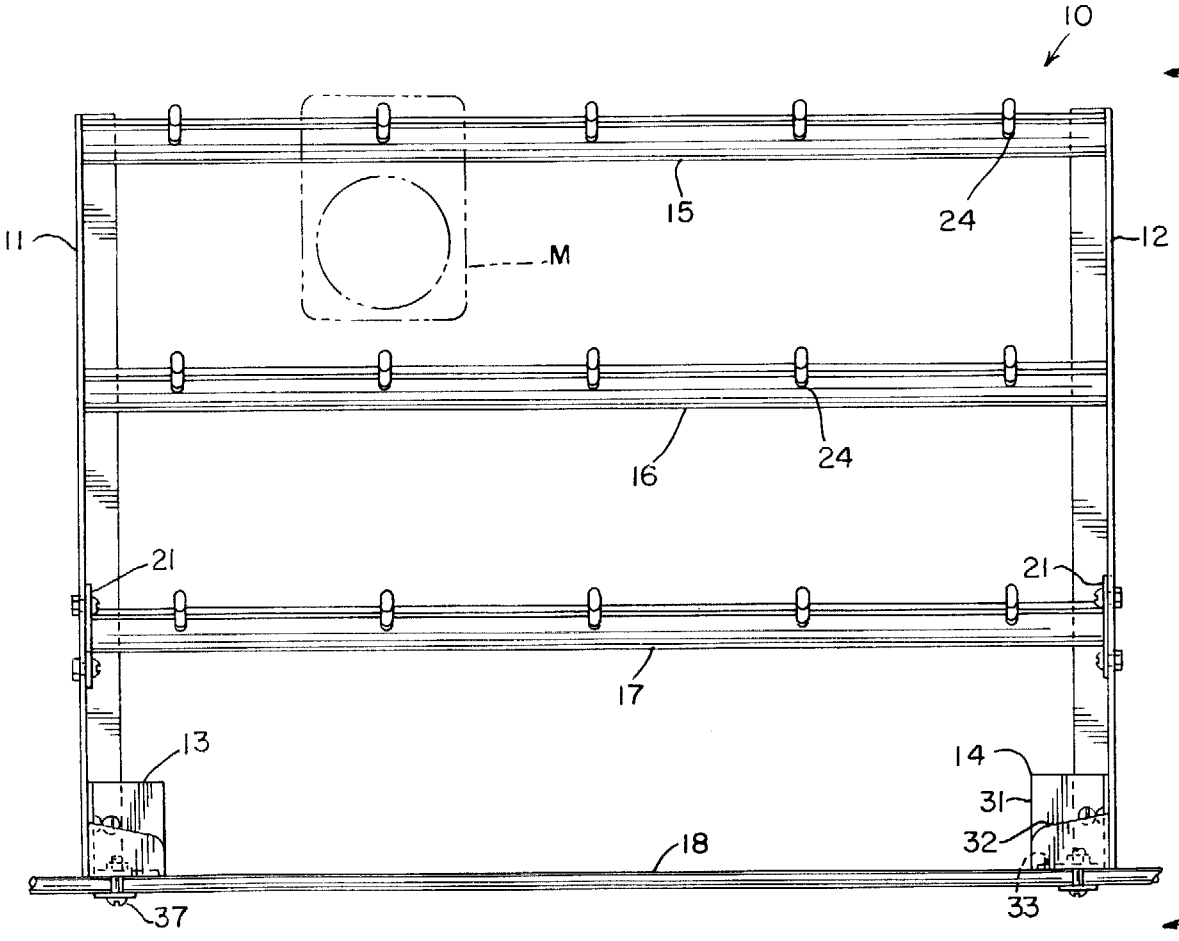
FIG. 1 is a front elevational view of a display rack made in accordance with the present invention and shown mounted on a horizontal shelf formed of parallel wire rods.

Each of the uprights 11 and 12 is formed of angle iron stock such as stainless steel, extruded aluminum or the like. One vertical leg of each upright 11 and 12 extends forwardly while the other legs extend inwardly toward each other in approximately the same plane. The pair of horizontal support bars 15 and 16 may also be in the form of angle members which are arranged so as to open upwardly as shown in FIG. 2 and which are permanently attached, e.g. welded, at their opposite ends to the uprights 11 and 12 in known manner. Optionally a third support bar 17 in the form of an angle member may be provided at its opposite ends with vertical mounting plates 20 and 21 which may be bolted to the uprights 11 and 12 as shown in FIGS. 1 and 2.

Each of the horizontal support bars 15, 16 and 17 provides support for a plurality of forwardly projecting peg rods 22-22 having upturned distal ends 23—23. It will be understood that packages of luncheon meat and the like may be suspended in known manner from the rods 22 as indicated by suspended luncheon meat package M shown in broken outline in FIG. 1.

Each of the support rods 22 is removably secured to one of the horizontal support bars at its rear end in the manner described and shown in the above-mentioned U.S. Pat. No. 3,486,632. That is, each of the horizontal support bars 15, 16 and 17 is provided with a plurality of upwardly opening slots 24-24 in the front leg and registering apertures 25 in the rear leg. An S-shaped spring clip member 26 fits over the bottom of each aperture 25 on the rear side of each support bar 15, 16 and 17 so as to press up against the rear end of each support rod 22 as shown in FIG. 2. This arrangement secures each rod 22 in place but permits ready removal when desired such as for loading purposes.

It will be understood that the details of the construction of the horizontal support bars 15, 16 and 17 and the manner in which the forwardly projecting support rods 22-22 are cantilevered therefrom do not form a part of the present invention.

The feet 13 and 14 are of similar construction except that one is left handed and the other is right handed. Accordingly, it will suffice to describe in detail the foot 14 with the understanding that the foot 13 corresponds except that it is opposite handed.

Figure 3:
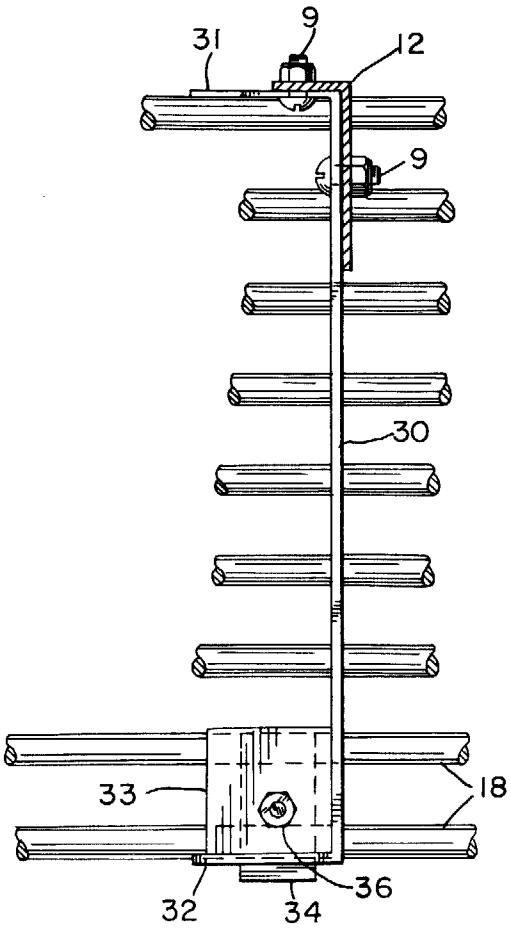
FIG. 3 is an enlarged fragmentary view taken on line 3—3 of FIG. 2.

The foot 14 is formed of sheet or plate stock preferably by stamping and bending operations which are readily performed on known shop equipment. The foot 14 has a main vertical web portion 30 the upper edge of which is downwardly inclined toward the front as shown in FIG. 2. At its heel or rear of the foot 14 the vertical section 30 is provided with a right angle flange 31 whereby the heel or rear portion of the foot 14 interfits within the bottom end of the upright 12, to the legs of which it may be readily bolted by bolts 9—9 as shown in FIG. 3.

At its forward or distal end the foot 14 is provided with both a vertical inwardly extending tab portion 32 and a horizontal inwardly extending flange 33.

The distal end of the foot 14 is securely clamped to the underlying shelf composed of the parallel wire rods 18 but by means of the clamping action provided by a clamp member 34 engaging the underside of a pair of the rods 18 co-operating with the flange portion 33 on the top of the rods, with these two clamping elements 33 and 34 being drawn together by means of a bolt 35 extending through registering apertures therein provided with a nut 36.

It will be understood that the clamping action at the distal end of the foot 14 and the corresponding action provided at the distal end of the foot 13 securely anchors the rack 10 in the desired location on the wire shelf. By loosening or removing the bolt clamp 35 and the corresponding bolt 37 for the foot 13 the rack 10 may be relocated as desired on the shelf or removed if so desired.

Figure 4:
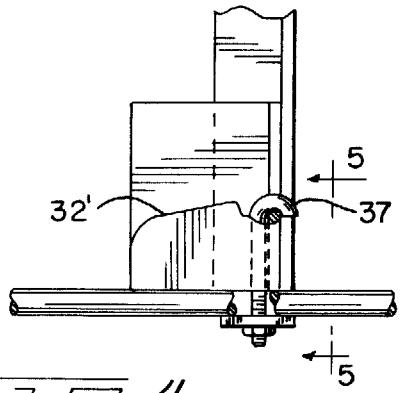
FIG. 4 is a detail elevational view of the distal end of one support foot member of the article display rack of FIGS. 1—3 but provided with a modified clamping means.
Figure 5:
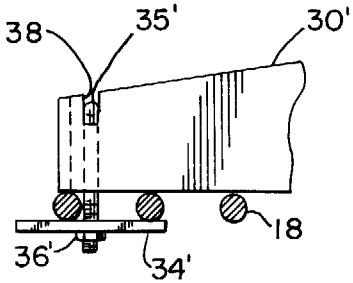
FIG. 5 is a fragmentary detailed view taken on line 5—5 of FIG. 4.

A modified clamping arrangement and formation for the distal end of the foot 14 is shown in FIGS. 4 and 5 wherein the vertical main section of the foot is designated at 30', an inturned vertical tab 32' is provided but no inwardly turned horizontal flange portion is provided that corresponds to the flange portion 33 in FIG. 3. The clamping action is provided by a clamping member 34' which is drawn upwardly against the underside of two of the wire rods 18 by means of a J-bolt 35' the lower end of which is threaded and provided with a nut 36' and the upper portion of which is in the form of a down-turned hook 37 which fits down in a slot 38 in the upper edge of the main section 30' over which it hooks as shown in FIGS. 4 and 5.

It will be seen that two of the wire rods 18—18 are firmly clamped by means of the J-bolt 35' between the clamp member 34 on the underside and the bottom edge of the main vertical section 30' at the top. As will be readily appreciated, the wire rods 18 may have other shapes and cross-sections and extend 90° to the direction shown or take the form of a grid.

What is claimed as new is:

1. A display rack for mounting on shelves formed of wire rods comprising a pair of end uprights formed of right angle members with one leg of each extending forwardly and with the other legs of said uprights extending inwardly toward each other in approximately the same plane, a plurality of support bars extending horizontally between said end uprights, a plurality of article supporting rods mounted at their rear ends on said horizontal support bars and projecting forwardly therefrom, a pair of foot members each of which is attached at its heel to the bottom of one of said uprights so as to extend forwardly therefrom, and clamping means at the distal end of each foot for clamping the distal end to at least one of said wire rods of a shelf, each of said foot members having a vertical right-angle formation at said heel thereof interfitting the upright to which it is attached, each of said clamping means having an upstanding J-bolt, a clamp member carried on the lower end of each said bolt and adapted to be drawn up under at least one wire rod so as to clamp the same between the underside of said foot member and said clamp member, each of said foot members being a sheet metal stamping with a vertical fore-and-aft main section and a second vertical right angle formation on the distal end of each foot member, said fore-and-aft main section providing one leg of each of said first and second right angle formations and the remaining legs of said formations on each foot member extending inwardly toward the other foot member, and the J-formation on each bolt hooking downwardly in a notch in the upper edge of one of said fore-and-aft main sections.

* * * * *